United States Patent [19]

Kallman

[11] Patent Number: 4,813,082

[45] Date of Patent: Mar. 21, 1989

[54] MITTEN ATTACHMENT FOR A GLOVE WITH AN APPENDAGE STOWAGE SYSTEM

[76] Inventor: Robert Kallman, 20-30 Haring St., Brooklyn, N.Y. 11229

[21] Appl. No.: 166,179

[22] Filed: Mar. 10, 1988

[51] Int. Cl.[4] ..... A41D 19/01

[52] U.S. Cl. ..... 2/158; 2/160

[58] Field of Search ..... 2/158, 160, 161 R, 161 A

[56] References Cited

U.S. PATENT DOCUMENTS

| | | | |
|---|---|---|---|
| 961,149 | 6/1910 | Maynard | 2/158 |
| 993,662 | 5/1911 | Dueease | 2/158 |
| 1,216,877 | 2/1917 | Stewart | 2/158 |
| 1,286,771 | 12/1918 | Raymond | 2/158 |
| 1,413,967 | 4/1922 | Clark | 2/158 |
| 1,786,227 | 12/1930 | Bruggeman | 2/158 |
| 2,274,335 | 2/1942 | Kennedy | 2/158 |
| 2,451,837 | 10/1948 | Londe et al. | 2/158 |
| 2,603,790 | 7/1952 | Boehm-Myro | 2/160 |
| 3,064,266 | 11/1962 | Veghte, Jr. | 2/158 |
| 3,403,408 | 10/1968 | Helfer | 2/158 |

*Primary Examiner*—Werner H. Schroeder
*Assistant Examiner*—Jeanette Chapman
*Attorney, Agent, or Firm*—Edwin D. Schindler

[57] ABSTRACT

The present invention provides a mitten attachment for use in combination with a glove, which may also be detachably attached, or permanently attached, to the glove, and which includes a stowage system to permit a wearer of the glove to safely and conveniently secure conventional pocket items, such as money or household or car keys. The mitten attachment of the invention is, preferably, secured to the wearer's hand, over a glove already being worn by the wearer, via a series of strap portions which preferably secure the mitten attachment by having one strap portion encircle the wrist area of the user and another strap portion encircling the palm area of the user. Each strap portion is preferably integral with the overall construction of the mitten attachment. Additional, or fewer, strap portions may be utilized with the present invention. Alternatively, the article of the present invention may be either permanently secured to the glove of the wearer or fully or partially detachably attached by means, for example, of Velcro. The mitten portion of the mitten attachment article may be utilized to hold conventional pocket items, such as money or keys. Such items may be placed within the mitten portion of the article and the mitten portion may then be folded back underneath the backside portion of the article to securely stow such article.

11 Claims, 3 Drawing Sheets

MITTEN ATTACHMENT FOR A GLOVE WITH AN APPENDAGE STOWAGE SYSTEM

BACKGROUND OF THE INVENTION

1. Technical Field of the Invention

The present invention relates to a mitten attachment for a glove in which the mitten attachment includes a storage system. More particularly, the present invention relates to a mitten attachment which is capable of being attached to a conventional glove for use in combination with the mitten attachment. The mitten attachment is constructed so that, in addition to providing greater warmth and comfort to the hands and, particularly, the fingers of the wearer, the attachment is also capable of being used as a means of stowage, for the wearer of the glove, for such items as pocket money and keys.

2. Description of the Prior Art

Heretofore, there have been various attachable mitten pieces for use in combination with gloves, or such pieces which otherwise have formed appendages of gloves. Such mitten pieces, however, were not capable of both acting as an additional protector element for the hands and fingers of the wearer and also capable of being manipulated for use as a convenient and secure stowage system for pocket items such as loose money, household keys, etc. The prior art, thus far, fails to provide or otherwise suggest a neat and convenient stowage system for the mitten attachment for use in combination with a glove.

SUMMARY OF THE INVENTION

It is, therefore, an object of the present invention to provide a mitten attachment for use in combination with a glove, which provides an additional measure of warmth and comfort to the wearer's hands and fingers.

It is a further object of the invention to provide a mitten attachment for use in combination with a glove which may either be permanently attached to the glove or which is capable of quick and easy detachment It is, yet a further object of the present invention to provide a mitten attachment, for use in combination With a glove, which provides a convenient, neat, flat and comfortable stowage system of the mitten pocket portion of the attachment so that the pocket portion smoothly fits against the backside of the glove.

It is an additional object of the present invention to provide a mitten attachment for a glove which is economical to manufacture.

The foregoing and related objects are achieved by the present invention which provides a mitten attachment for use in combination with a glove, which may also be detachably attached to the glove, and which includes a stowage system to permit a wearer of the glove to safely and conveniently secure conventional pocket items, such as money or household or car keys.

The mitten attachment of the invention is preferably, secured to the wearer's hand, over a glove already being worn by the wearer, via a series of strap portions which preferably secure the mitten attachment by having one strap portion encircle the wrist area of the user and another strap portion encircling the palm area of the user. Each strap portion is preferably integral with the overall construction of the mitten attachment. Additional, or fewer, strap portions may be utilized with the present invention. One wide strap may be used wherein a thumb hole is provided.

As part of the mitten attachment article of the invention, the article includes a backside portion which covers the backside of the user's hand, i.e., the side of the user's hand opposite the user's palm. It should, of course, be understood that the mitten attachment article of the invention fits over the glove already being worn by the user. Accordingly, the backside portion of the mitten attachment article necessarily also covers the backside of the glove. The strap portions of the article should preferably be integrally attached to the backside portions of the mitten attachment.

Finally, the mitten attachment article of the invention includes a mitten portion which is integrally attached to the backside portion of the article. More particularly, the mitten portion of the inventive article comprises a pocket portion which encloses the fingers of the user in a fashion analogous to the way that a conventional mitten would enclose one's fingers. The upper portion of the mitten portion of the invention, however, is integrally attached to the backside portion of the mitten attachment. The lower portion of the mitten portion of the article is unattached. The terms "upper portion" and "lower portion," with respect to the mitten portion of the article, refer to the segment of material of the mitten portion when the user is wearing the invention and the palms of the user's hands are facing downward toward a floor.

The mitten portion therefore forms a pocket for either the fingers of the user or for the placement of pocket change, keys, etc. When the mitten portion is used as a protective cover for the user's fingers, it is contemplated that the mitten portion of the invention will enclose the fingers of the user, which are separately enclosed, previously, in a glove. When the mitten portion is contemplated for use as a pocket for conventional pocket items, keys, pocket change, etc., are placed within the mitten portion of the inventive mitten attachment. The mitten portion is then folded smoothly under the backside portion of the invention and the contents of the mitten portion are securely and safely stowed while the wearer engages in other activity.

The mitten attachment article of the present invention may be made, preferably, of any relatively durable, flexible material. A preferred material for making the invention is neoprene.

Other objects and features of the present invention will be discussed and described in further detail hereinafter, with reference being made to the accompanying drawing figures. It should, however, be pointed out that the accompanying figures illustrate but one preferred embodiment of the invention and are not intended as a definition of the limitations of the invention or of the scope thereof.

BRIEF DESCRIPTION OF THE DRAWINGS

In the drawing, wherein similar reference numeral denote similar features throughout the several views.

DETAILED DESCRIPTION OF THE DRAWING

Figure 1:
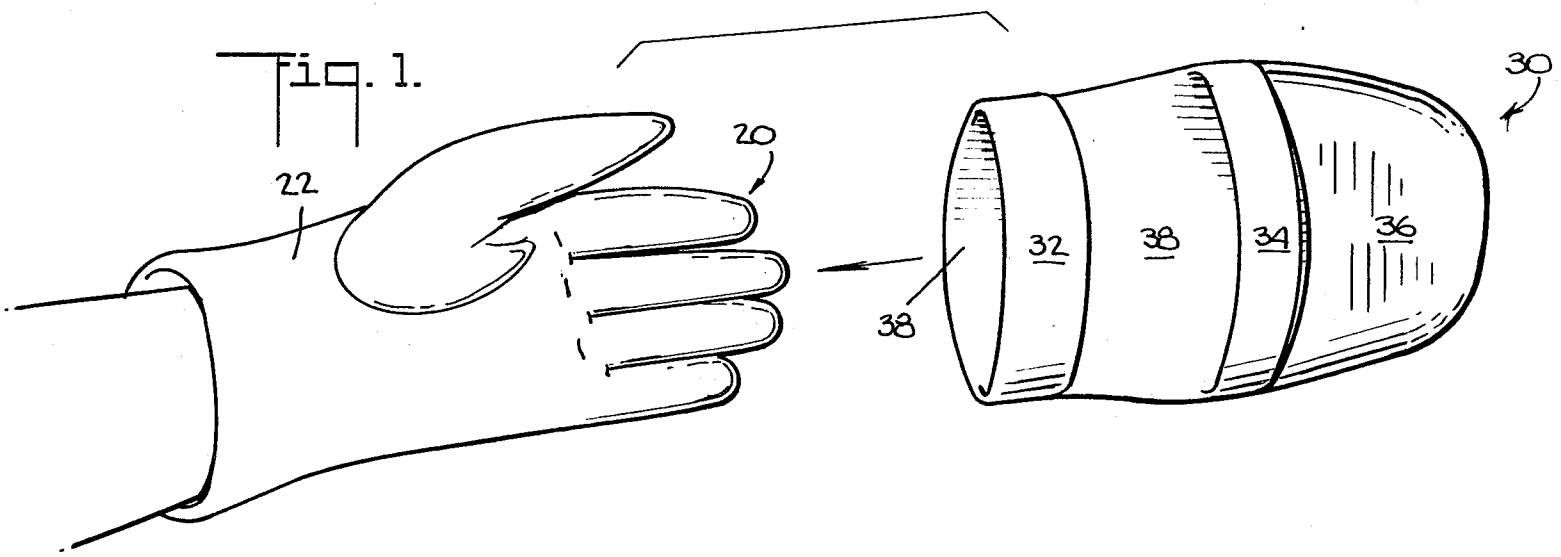
FIG. 1 is an elevational view showing the mitten attachment article of the present invention prior to securement to the gloved hand of a user.

Turning now, in detail, to the drawing, FIG. 1 is an elevational view of the gloved hand of a user 20 with glove 22 thereon. FIG. i also shows the mitten attachment article of the present invention, designated by the reference numeral 30. Attachment 30 includes strap portions 32, 34 and mitten portion 36. A portion of the inner side of backside portion 88 is also visible in FIG. 1. As indicated by the arrow in the figure, mitten attachment 30 is to be secured, i.e., detachably detached, over glove 22 of the user hand.

Figure 3:
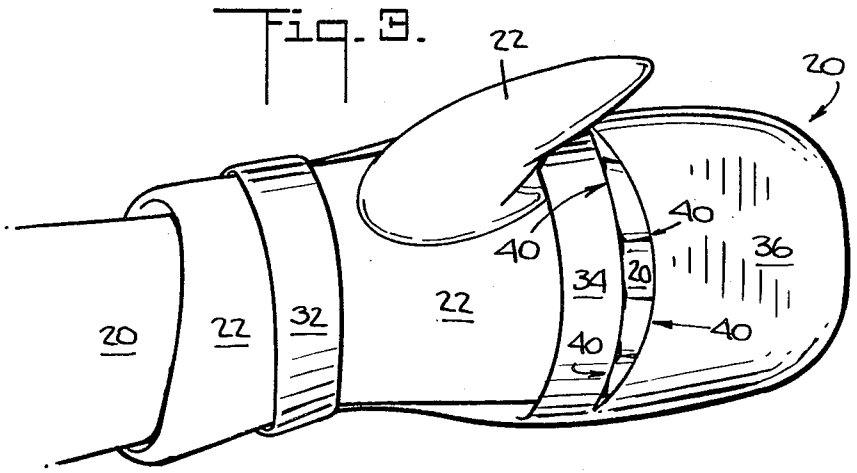
FIG. 3 is an elevational view of the mitten attachment article of the present invention secured to the gloved hand of a user with the mitten portion shown enclosing the user's fingers.
Figure 2:
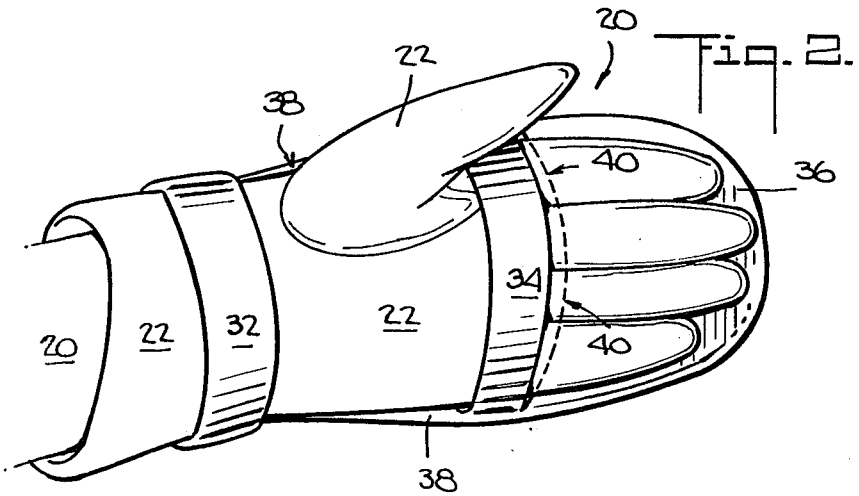
FIG. 2 is an elevational view of the mitten attachment article of the present invention secured to the gloved hand of a user, with the mitten portion of the article being drawn to show the gloved fingers of the user therein.
Figure 8:
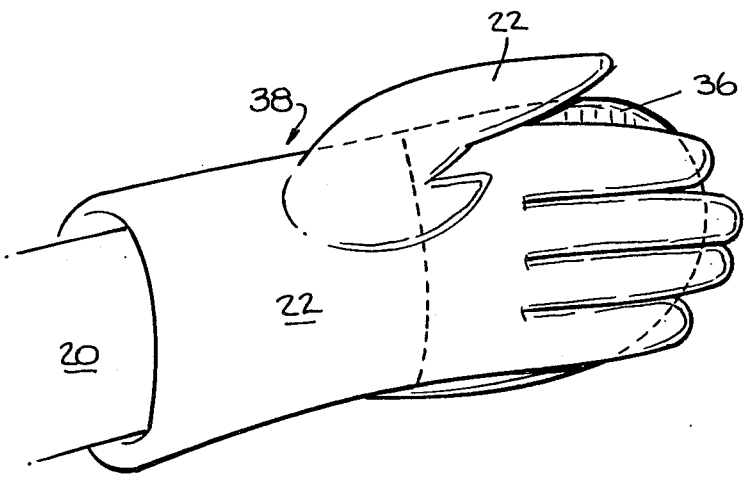
FIG. 8 is an elevational view of another preferred embodiment of the mitten attachment article of the invention secured to the hand of a user, as viewed from the inner side of the hand of said user, with the gloved fingers of the user unenclosed by the mitten portion of the invention.

Mitten attachment 30 is secured, in one possible mode, over glove 22 in the manner shown in FIG. 2. In this mode strap portion 82 encircles the lower part of a user's hand or wrist. Strap portion 84 wraps around the user's hand below the user's fingers and above the user's thumb. The preferred means by which strap portions 82 and 34 encircle the user's gloved hand is shown in FIGS. 2 and 3. In FIGS. 2 and 3, backside portion 88 of attachment 80 is secured against the outer side of the user's hand. i.e., the side opposite of the palm of the user's hand. In FIG. 2, mitten portion 36 is shown as not enclosing the fingers of the user and instead, rests upon the back of the user's fingers. In FIG. 8, mitten portion 36 is shown as enclosing the user's fingers. In order to secure the mitten attachment to the gloved hand of a user the user would first secure strap portions 32, 84 around has wrist and hand as shown in FIG. 2, and then would deform, or otherwise pull mitten portion 36 in a fashion in order to secure the user's fingers, as shown in FIG. 8.

In order that the user's fingers, contained in glove 22 and mitten portion 86, are sufficiently flexible, as well as to enable the user to readily secure the mitten attachment 30, strap portion 34 and mitten portion 36 should separated from one another by a slit, the outline of which is designated by the reference numeral 40.

The mitten attachment 30 should preferably be made so that all features of the article are integral with one another. Attachment 80 should be made out of a flexible material Which is preferably resistant to water and is capable of providing additional warmth to the hands of the user. A preferred material for making the inventive attachment is neoprene.

Figure 4:
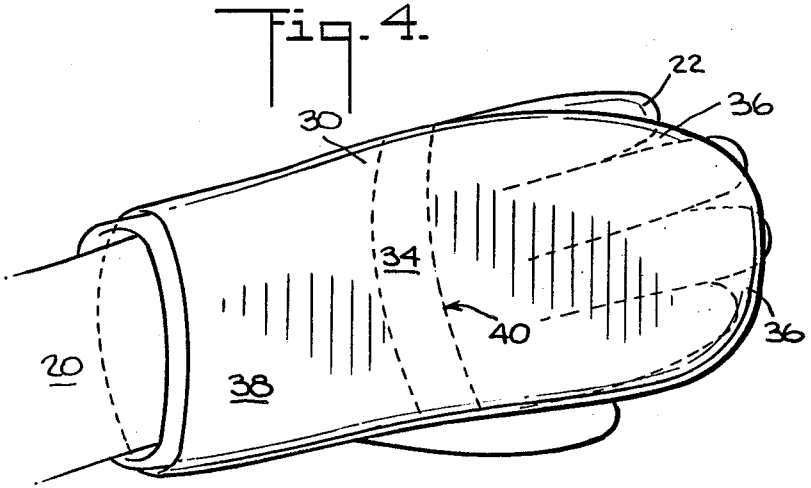
FIG. 4 is an elevational view of the mitten attachment article secured to the gloved hand of the user, as in FIG. 3, however, the mitten portion of the article as not enclosing the gloved fingers of the user.

Referring to FIGS. 4–7, these figures show elevational views of the mitten attachment 80 of the present invention, as seen from the backside of the hand of the user, i.e., the side of the user's hand opposite the user's palm. FIG. 4 shows the mitten portion 36 of the invention as resting upon the gloved fingers 22 of the user. FIG. 4 is analogous to drawing FIG. 2; the view being from the opposite side of the user's hand.

Figure 5:
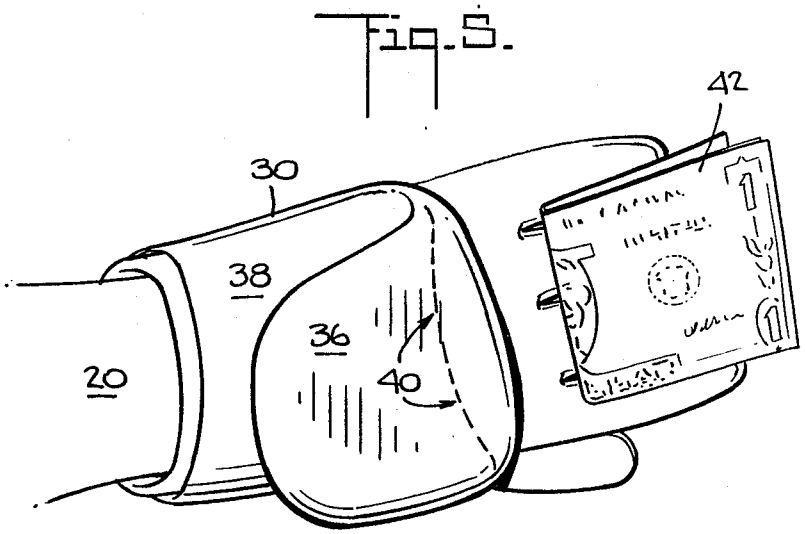
FIG. 5 is an elevational view of the mitten attachment article of the invention secured to the hand of a user with the mitten portion of the invention folded back prior to the placement of money therein.
Figure 7:
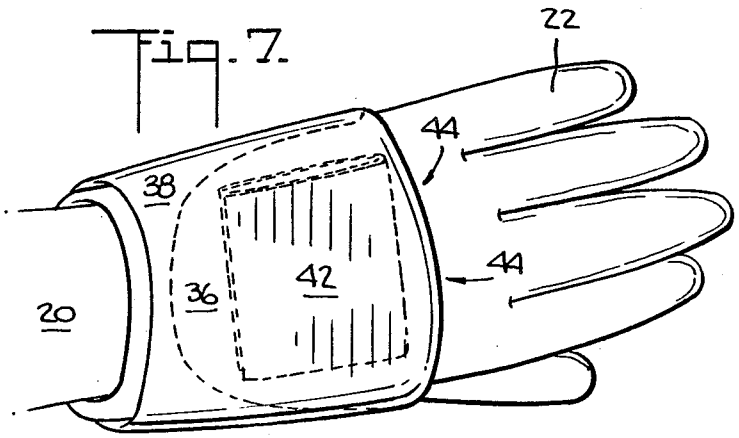
FIG. 7 is an elevational view of the mitten attachment article of the invention secured to the hand of a user with the mitten portion of the article, with the contents thereof as shown in FIG. 6, folded underneath the backside portion of the article.
Figure 6:
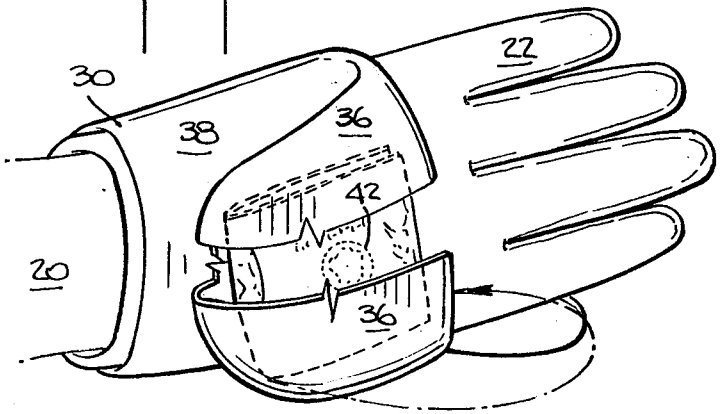
FIG. 6 is an elevational view of the mitten attachment article of the invention secured to the hand of a user with the mitten portion of the article shown as partially broken away to show the contents of the mitten portion.

FIG. 5 shows the mitten portion of FIG. 4 pulled backward toward backside 38. By pulling mitten portion 36 in the fashion shown, mitten portion 86, which may enclose the gloved fingers of the user, as shown in FIGS. 1–8, may alternatively contain items such as money (designated by the reference numeral 42). FIG. 6, with a section of the mitten portion broken away, illustrates the placement of money 42 within mitten portion 36. Finally, after placement of money or other items in the mitten portion of the present invention, it is preferred that mitten portion 86, with its contents 42, be folded toward the gloved fingers 22 of the user and then underneath backside portion 88 of the mitten attachment 30. In this fashion, the contents 42 are securely stowed upon the backside of the user's hand for convenience and safety. The fold (designated by the reference numeral 44) of the mitten portion prevents the contents of the mitten portion, when folded flat beneath the backside portion 38 of the glove attachment from exiting or otherwise unintentionally falling out of the mitten portion of the invention. The end opposite to fold 44 is, of course, sealed closed.

Figure 9:
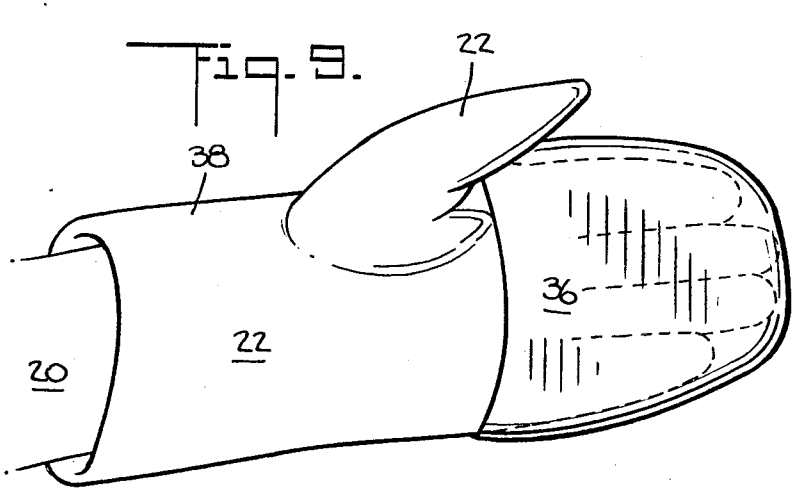
FIG. 9 is an elevational view of the embodiment of the mitten attachment article of FIG. 8 secured to the hand of a user, as viewed from the inner side of the hand of said user, with the gloved fingers of the user enclosed by the mitten portion of the invention; and, FIG. 10 is a side view of the embodiment of the mitten attachment article of FIG. 8 secured to the hand of a user, as viewed from the inner side of the hand of said user, with the gloved fingers of the user unenclosed by the mitten portion of the invention.
Figure 10:
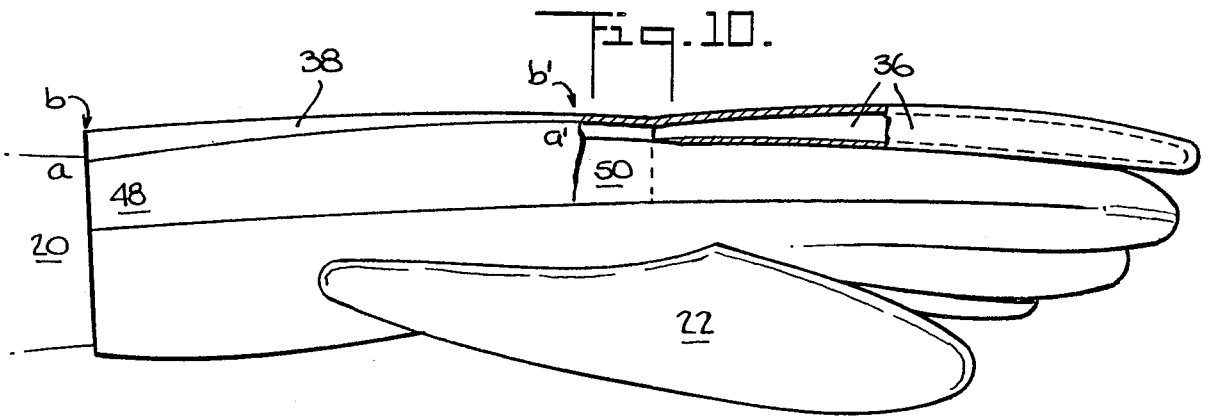

FIGS. 8–10 illustrate an alternatively preferred embodiment of the present invention. In this embodiment, instead of utilizing strap portions to secure the mitten attachment article of the invention to the glove of a user, the mitten attachment of the invention is permanently affixed, or otherwise integral with the user's glove.

One possible embodiment of such a construction is presented in FIGS. 8–10 In this embodiment, backside portion 38 of the inventive article 80 is permanently sewn to the backside of the user's grove alone the along one, two or three edges of the backside portion 38. Preferably, if backside portion 38 is sewn along two or three edges (other than the edge which mitten portion 86 is affixed), a pocket is created between the backside of the user's glove and the backside portion 38 of the mitten attachment of the invention. In this embodiment, mitten portion 36 is of substantially the same construction, and made of the same material, as the embodiment shown in FIGS. 1–7. The interface between the mitten portion 86 of the embodiment of FIGS. 8–10 and the backside portion 38, of this same embodiment should, preferably, not be attached to the backside of the user's glove. In this way, access to the pocket created between the backside portion 88 of the attachment and the backside of the glove is obtained. With such a construction money, keys or other items may be stored in mitten portion 36 and may then be securely stowed away by folding back in the pocket created between the backside portion of the attachment and the backside portion of the glove, in a manner similar to that shown in FIGS. 4–7.

Alternatively, backside portion 38, instead of being completely sewn along its edges to the backside of glove 22, may be attached, or even detachably attached, at its corners (designated a, a', b, b' in FIG. 10). By this means of attachment it is possible to place, for example, Velcro or some other material capable of detachable attachment, at corners a, a' and/or b, b', so that backside portion 88 may be opened. In this fashion, mitten portion 36 may be supplied more easily with contents wished to be stowed, then folded toward backside portion 38 (in the manner shown in FIG. 7). The corners, e.g., a and a', or, b and b' of backside portion 88 may then be secured to the backside of glove 22, with Velcro, for example, with the contents of the mitten portion 36 being safely and securely stowed therein (see, FIG. 7). Alternatively, instead of the corners being provided with Velcro, or a material, Velcro may be placed upon straps (designated by the reference numerals 48 and 50 in FIG.10) extending from backside portion 88 of the mitten attachment. Such straps are analogous to the corners a, a', b, b', described above.

Additional variations and modifications of the present invention, it should be recognized, are, of course, possible. For example, in the embodiment wherein two or more corners of the backside portion of the mitten attachment are secured to the backside portion of the glove Velcro or a similar material may be placed at numerous portions other than at the corners. Alternatively, only one strap, or more than two straps (two straps being shown in FIG. 10), may be supplied with Velcro to secure the backside portion of the invention to the glove of the user following placement of the contents intended for stowage within the mitten portion of the invention.

While only several embodiments of the present invention have been shown and described, it will be obvious to those skilled in the art that many modifications may be made to the invention without departing from the spirit and scope thereof.

What is claimed is:

1. A mitten attachment article for a glove, the glove being worn on the hand of a wearer, said mitten attachment article being intended for use on the glove of the hand, of the wearer, said mitten attachment article comprising:

a backside portion which is to be in communication with the backside of the glove;

means for securing said backside portion of said mitten attachment article to the glove of the wearer; and, a mitten portion attached to said backside portion of said mitten attachment article, said mitten portion being capable of enclosing the gloved fingers of the bearer of the glove and said mitten portion also being capable of containing items for stowage, said mitten portion being capable of being folded flat underneath said backside portion for secure stowage of said items.

2. The mitten attachment article according to claim 1, wherein said mitten attachment article is made of a flexible material.

3. The mitten attachment article according to claim 2,

4. The mitten attachment article according to claim 1, wherein said backside portion, said means for securing and said mitten portion are formed as an integral construction.

5. The mitten attachment article according to claim 1, wherein said means for securing said backside portion to said glove are means for detachable attachment.

6. The mitten attachment article according to claim 6, wherein said means for securing is, at least, one encircling strap which is attached to opposite edges of said backside portion of said mitten attachment article, said encircling strap being capable of encircling the gloved hand of the wearer to secure said article onto the gloved hand of the wearer.

7. The mitten attachment article according to claim 1, wherein said means for securing said backside portion of said mitten attachment article to said glove includes means for the detachable attachment of at least a portion of said backside portion of said mitten article.

8. The mitten attachment article according to claim 7, wherein said means of detachable attachment of at least a portion of said backside portion of said mitten article to said glove is carried out with a complementary hook-and-loop material on said backside portion and the glove.

9. The mitten attachment article according to claim 7, wherein said means for detachable attachment of at least a portion of said backside portion of said mitten article to said glove is by means of at least one strap extending from said backside portion of said mitten article, said strap and said glove having complementary hook-and-loop material for detachable attachment.

10. The mitten attachment article according to claim 1, wherein said means for securing said backside portion of said mitten attachment article is by a permanent attachment of said backside portion to said backside of the glove.

11. The mitten attachment article according to claim 10, wherein said permanent attachment of said backside portion to said backside of the glove forms a pocket between said backside portion of said mitten attachment article and the backside of the glove of the wearer whereby the wearer is capable of placing items within said mitten portion of said article and is capable of folding said mitten portion into said pocket formed between said backside portion of said mitten attachment article and the backside of the glove of the wearer.

* * * * *